US011651756B2

(12) United States Patent
Lee

(10) Patent No.: US 11,651,756 B2
(45) Date of Patent: May 16, 2023

(54) MUSICAL INSTRUMENT CASE

(71) Applicant: Earl Eugene Lee, Nashvill, TN (US)

(72) Inventor: Earl Eugene Lee, Nashvill, TN (US)

( * ) Notice: Subject to any disclaimer, the term of this patent is extended or adjusted under 35 U.S.C. 154(b) by 0 days.

(21) Appl. No.: 17/461,974

(22) Filed: Aug. 30, 2021

(65) Prior Publication Data

US 2023/0060297 A1 Mar. 2, 2023

(51) Int. Cl.
*G10G 7/00* (2006.01)
*A45C 13/00* (2006.01)

(52) U.S. Cl.
CPC ..... *G10G 7/005* (2013.01); *A45C 13/005* (2013.01); *A45C 2200/15* (2013.01)

(58) Field of Classification Search
CPC . E05D 3/00; E05D 3/06; Y10T 16/542; Y10T 16/546; Y10T 16/547; B65D 5/5206; G10G 7/005; A45C 13/005; A45C 2200/15
USPC ..... 206/314, 45.23, 45.2; 16/366, 367, 368, 16/369; 220/817, 818, 819
See application file for complete search history.

(56) References Cited

U.S. PATENT DOCUMENTS 1,352,814 A 9/1920 Kirk
1,988,718 A 1/1935 Cook et al.
2,874,866 A * 2/1959 Rudy ..... B65D 43/163 220/817
3,637,070 A 1/1972 Friedman
3,881,221 A * 5/1975 Schmidt ..... E05D 3/186 16/361
4,127,214 A * 11/1978 Pedraza ..... B65D 90/0086 16/225
4,147,254 A 4/1979 Bruce
4,151,909 A 5/1979 Markov
4,223,785 A 9/1980 Jacques
4,474,290 A 10/1984 DeMato
5,590,771 A 1/1997 Cota
5,737,183 A * 4/1998 Kobayashi ..... G06F 1/1626 361/679.56
5,833,051 A 11/1998 Tiefenbrun et al.
6,145,801 A 11/2000 Herring, Jr.
6,845,875 B2 * 1/2005 Grattan ..... A47C 17/80 220/4.23
6,951,280 B1 * 10/2005 Lee ..... A45C 9/00 206/14
6,959,810 B2 * 11/2005 Neilson ..... A45C 11/24 206/204
2017/0268266 A1 * 9/2017 Lee ..... E05D 11/06

* cited by examiner

*Primary Examiner* — Steven A. Reynolds
(74) *Attorney, Agent, or Firm* — Jacob W Neu; Bradley Arant Boult Cummings LLP

(57) ABSTRACT

A musical instrument carrying case having a receptacle and a lid is disclosed herein. The carrying case has a hinge that allows the lid to rotate around behind the receptacle to create an instrument stand. The hinge has at least four plates and three axles, including a free axle that permits the hinge to collapse together, resulting in a shortened distance between the lid and receptacle when in an open position.

1 Claim, 2 Drawing Sheets

MUSICAL INSTRUMENT CASE

FIELD OF THE INVENTION

The present invention relates generally to carrying cases for stringed instruments.

BACKGROUND OF THE INVENTION

Stringed instruments are typically carried in a case. The instrument is then removed for playing, but the case must be stored or set away during play. This can be difficult when show venues are small.

To remedy this problem and to provide a stand further advantageously for setting the instrument in, U.S. Pat. No. 6,951,280 provides for a musical instrument case having a hinge on the top, such that the case can stand up. However, the design requires a large bracket to encompass the thickness of the case, which necessarily sets a large minimum distance required for standing up the musical instrument case. This can present a problem when the stage or playing area is small. Therefore, a case design having a small minimum distance would be advantageous.

SUMMARY OF THE INVENTION

In some respects the invention is directed to a case for a musical instrument having a receptacle defining an cavity dimensioned for receipt of an instrument, a lid sized and shaped to enclose the cavity of the receptacle, and a hinge for hingedly connecting the lid to the receptacle, the hinge having two plates connected by a hinge axle, wherein each plate is free to rotate relative to the free axle and to the receptacle and lid, and further wherein said free axle is permitted to rotate over 270 degrees.

In additional respects the invention is directed to a case for a musical instrument having a receptacle defining an cavity dimensioned for receipt of an instrument, a lid sized and shaped to enclose the cavity of the receptacle; and a hinge for hingedly connecting the cover to the case body, the hinge having a receptacle plate secured to the receptacle and having an axle end, a receptacle axle attached to the receptacle plate at the axle end, a first free plate having a first end and a second end, the first free plate attached at a first end to the receptacle axle, the receptacle axle capable of rotating in excess of 180 degrees, a free axle attached to the second end of the first free plate, the free axle capable of rotating in excess of 270 degrees a second free plate having a first end and a second end, the second free plate attached at the first end to the free axle, a lid axle attached to the second end of the second free plate, the lid axle capable of rotating in excess of 180 degrees, and a lid plate secured to the receptacle and having an axle end attached to the lid axle.

DETAILED DESCRIPTION

Figure 2:
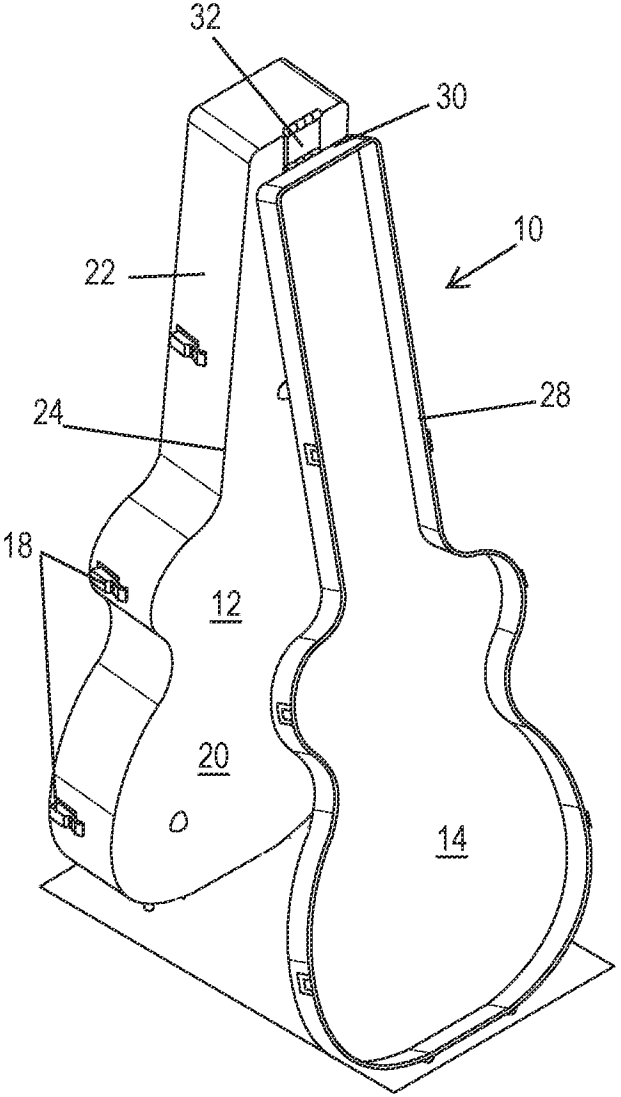
FIG. 2 is an isometric back view of the guitar carrying case shown in FIG. 1.
Figure 1:
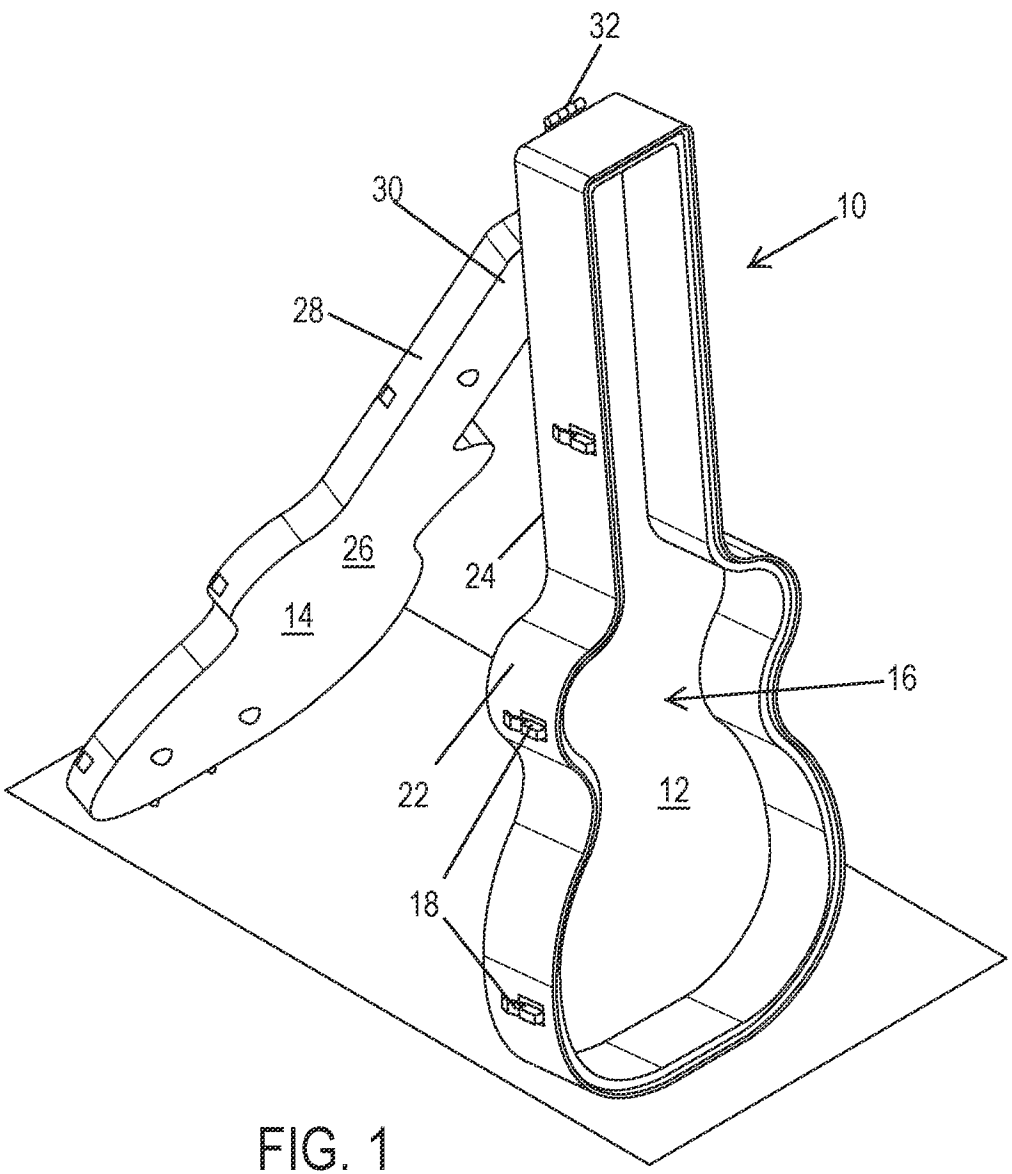
FIG. 1 is an isometric front view of a guitar carrying case constructed in accordance with the present invention.

Referring to the drawings in detail, a case 10 for a musical instrument is shown in FIGS. 1-5. For the following description of the invention, "top" and "bottom" are indicated with reference to the orientation depicted in FIG. 1. The case 10 may be dimensioned and used for carrying or protecting any stringed musical instrument, such as a banjo, mandolin, double bass, bass guitar, guitar, cello, fiddle, violin, viola, etc. As depicted in FIG. 1, the case 10 is sized for use with a guitar or bass guitar.

An instrument case typically has a receptacle 12 defining a cavity 16 for receiving the instrument and a lid 14 for enclosing the instrument within the case. The receptacle 12 has a back 20 and one or more raised sides 22. The side 22 and back 20 define a receptacle edge 24. The lid 14 has a front 26 and sides 28 dimensionally aligned with the sides 22 of the receptacle 12, such that when closed the lid 14 and receptacle 12 substantially or fully enclose the cavity 16. The front 26 and sides 28 define a lid edge 30. The lid 14 may be secured to the receptacle for travel or carrying the instrument. As shown in FIG. 1, the lid 14 is secured to the receptacle 12 by one or more buckles or clasps 18 attached to the outside of the receptacle 12 and/or lid 14. Other nonlimiting examples of mechanisms for securing the lid 14 to the receptacle 12 include ties or locks.

A hinge 32 permanently secures the lid 14 to the receptacle 12. Referring to Figure A, the hinge 32 is shown on the "top" of the case 10, that is, where the headstock of the stringed instrument is enclosed. While this is the preferred location of the hinge, 32, the hinge 32 may be placed at other desired locations around the case 10. As shown in Figure B, the hinge 32 is a triple hinge having four plates and three axles.

In some embodiments, the first plate or lid plate 34 is permanently secured to the front 26 of the lid 14. A first axle or lid axle 36 is located along or near the lid edge 30. Alternatively, the lid plate 34 may be secured to the side 28 of the lid, with the lid axle 36 located along the side 26. In either case, the lid plate 34 is fixed to the lid 14.

In a similar manner, the fourth plate or receptacle plate 38 may be permanently secured to the back 20 or the side 22 of the of the receptacle 12. The third axle or receptacle axle 40 is located along the receptacle edge 24 or the side 22, respectively, depending on where the receptacle plate 38 is located.

The second plate 42 and the third plate 44 are connected by the second axle or free axle 46. The second plate 42 connects on its other end to the lid axle 36. The third plate 44 connects on its other end to the receptacle axle 40. The free axle 46 preferably has a wide range of motion. For example, the free axle 46 may be rotatable through 340 degrees, such that the second and third plates 42, 44 are separated by 20 degrees at its maximum rotation. Other degrees of rotation (e.g., between 270-350 degrees may also be used depending on the design of the hinge and axle.

Figure 5:
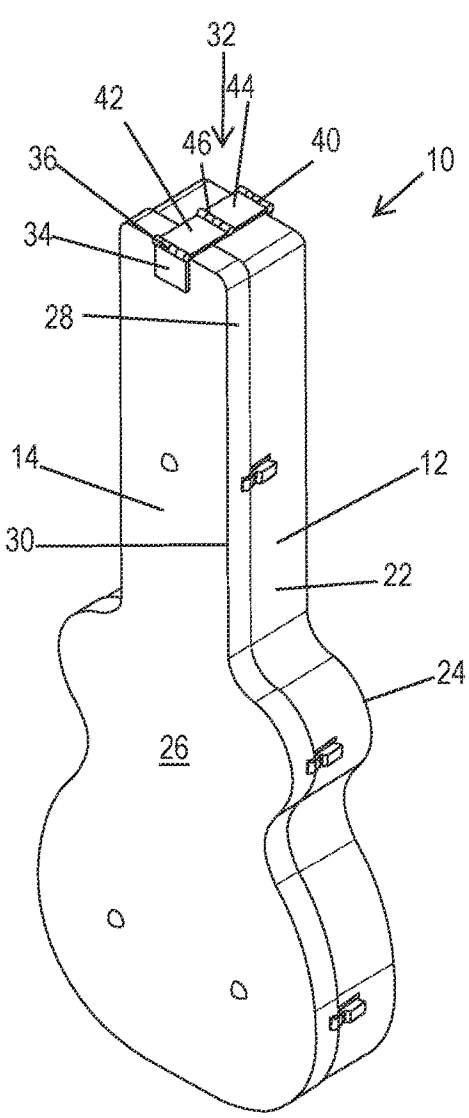
FIG. 5 is an isometric view of the guitar carrying case shown in FIG. 3
Figure 4:
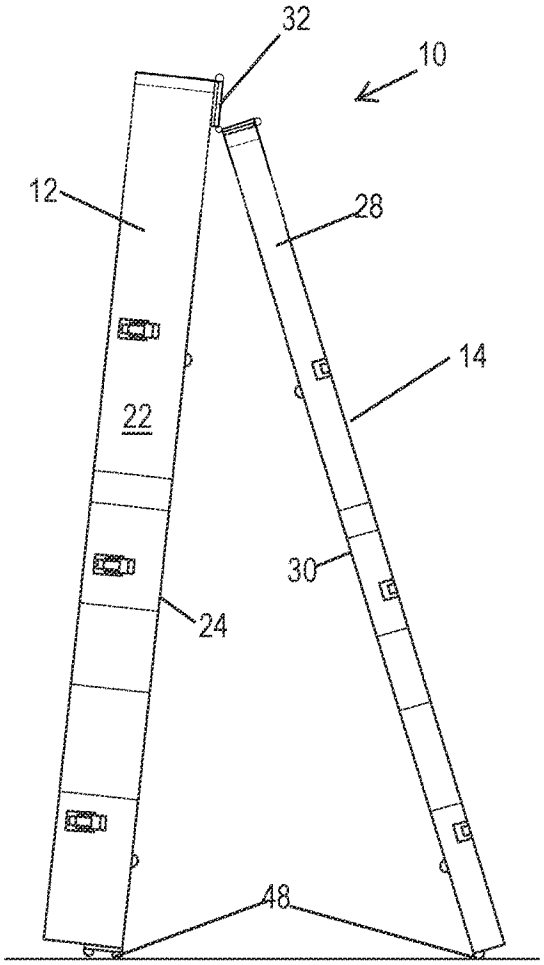
FIG. 4 is a side view of the guitar carrying case shown in FIG. 1 in an open position.
Figure 3:
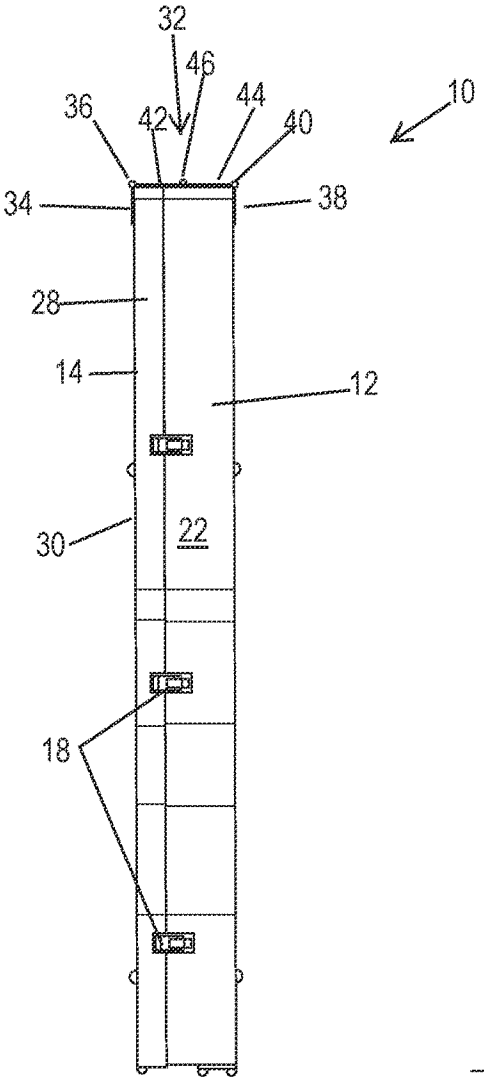
FIG. 3 is a side view of the guitar carrying case shown in FIG. 1 in the closed position.

As shown in FIGS. 1 and 4-5, the case 10 may be placed in a standing position by opening the lid 14 and rotating it around the hinge 32 until it is positioned behind the receptacle 12. The free axle 46 may be rotated into a completely open position, such that the second and third plates 42, 44 are positioned next to each other with the minimal angle of separation permitted by the free axle 46. In this manner, the two plates are situated adjacent to each other and draw the top end of the lid 14 substantially level or nearly level with the top end of the receptacle 12.

By drawing the top of the lid 14 higher, the bottom of the lid 14 is brought closer to the bottom of the receptacle 12, such that less space is required for standing up the case 10 in the open position than is required in prior known configurations.

Rubber stops 48 may be placed at the opposite end of the case 10 to increase friction and reduce the chances of sliding. However, as described above, the free axle 46 between the second and third plates 42, 44 allows an additional axis of rotation that draws the lid 14 closer to the receptacle 12 when in an open position. This reduces the angle between the lid and/or receptacle and the floor, such that the case 10 has a reduced tendency to slide. In some embodiments the lid 14 and receptacle 12 may be drawn together sufficiently to eliminate the need for rubber stops 48. Alternatively buckles or clasps 18 on the bottom end of the case 10 may also be used as stops for preventing sliding.

A case 10 may be manufactured to open in the manner described herein. Alternatively, a preexisting case may be retrofitted to open in this manner using a kit. The kit may include a hinge 36 of the kind described herein with four plates and three axles; and a plurality of screws, bolts, or other fastening elements for securing the receptacle plate to the receptacle and the lid plate to the lid. Existing hinges on the existing case are first removed from the case. The hinge 36 is then attached to the top of the case 10 using the fastening mechanisms.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A case for a musical instrument, comprising:

(a) a receptacle defining a cavity dimensioned for receipt of an instrument;

(b) a lid sized and shaped to enclose the cavity of the receptacle; and (c) a hinge for hingedly connecting the lid to the receptacle, the hinge comprising i) a receptacle plate secured to the receptacle and having an axle end;

ii) a receptacle axle attached to the receptacle plate at the axle end;

iii) a first free plate having a first end and a second end, the first free plate attached at the first end to the receptacle axle, the receptacle axle capable of rotating in excess of 180 degrees;

iv) a free axle attached to the second end of the first free plate, the free axle capable of rotating in excess of 270 degrees;

v) a second free plate having a first end and a second end, the second free plate attached at the first end to the free axle;

vi) a lid axle attached to the second end of the second free plate, the lid axle capable of rotating in excess of 180 degrees; and vii) a lid plate secured to the lid and having an axle end attached to the lid axle.

* * * * *